US007494168B1

(12) United States Patent
Miller

(10) Patent No.: US 7,494,168 B1
(45) Date of Patent: Feb. 24, 2009

(54) TEST TUBE PICKER FOR RACK STORED TEST TUBES

(76) Inventor: David Miller, 2500 Dean Lesher Dr., Suite A, Concord, CA (US) 94520

( * ) Notice: Subject to any disclaimer, the term of this patent is extended or adjusted under 35 U.S.C. 154(b) by 392 days.

(21) Appl. No.: 11/039,187

(22) Filed: Jan. 19, 2005

(51) Int. Cl.
*B66C 1/42* (2006.01)

(52) U.S. Cl. ..... 294/103.1; 294/902

(58) Field of Classification Search ..... 294/103.1, 294/902, 100, 50.9, 119.1; 901/31, 39; 422/100; 73/864.42
See application file for complete search history.

(56) References Cited

U.S. PATENT DOCUMENTS 2,882,085 A * 4/1959 Abbott ..... 294/103.1
4,696,501 A * 9/1987 Webb ..... 294/103.1
4,705,311 A 11/1987 Ragard
6,068,437 A 5/2000 Boje et al.
6,255,614 B1 7/2001 Yamakawa et al.
6,435,582 B1 * 8/2002 DaSilva et al. ..... 294/94
6,919,044 B1 7/2005 Shibata et al.

* cited by examiner

*Primary Examiner*—Paul T Chin
(74) *Attorney, Agent, or Firm*—Richard Esty Peterson

(57) ABSTRACT

A test tube pick system for picking and placing test tubes in a rack that includes a hand-held pick unit that communicates with a host device that assists in instructing the picking and placement of test tubes, the hand-held pick unit having a housing with a hand grip portion, a control portion with an actuator control and a display for displaying alphanumeric characters for pick and placement locations, a pick portion having four extending fingers with bent ends forming four parallel spaced end prongs, and an actuator mechanism that displaces and spreads at least two of the four end prongs when the actuator control is activated by a user.

15 Claims, 4 Drawing Sheets

TEST TUBE PICKER FOR RACK STORED TEST TUBES

BACKGROUND OF THE INVENTION

This invention relates to a test tube picker for rack stored test tubes and in particular to an ergonomic hand-held, electronic pick unit with system intelligence adapted for cord or cordless use.

The field of bioscience has exploded and its demands have advanced procedures for analytical chemistry and life science studies. Laboratories routinely employ trays to store and organize numerous test tube racks which are containment structures for densely packed upright test tubes. The test tubes are typically small polymer casings, ranging in capacity from 0.5-2 ml with or without a cap or stopper, arranged in an orthogonal matrix.

A standard rack holds ninety-six tubes in an eight by twelve matrix. Typically, the rack has a top deck with individual holes or cells into which the casings are inserted with upper portions of the casings projecting well above the deck and the lower portion of the casings retained by ribs or dividers in the containment structure. Frequently, the bottom of the rack is designed to allow viewing of the bottom of the casings, particularly when the casing bottom is marked with an identifier such as a 2-D barcode.

Sophisticated operations include robotic pickup and placement mechanisms for multi-rack test and scanning beds. Inevitably, even in sophisticated operations, the necessity arises to manually select and remove or place a single test tube at a particular location in an array of tubes.

Because the tubes are packed in an orthogonal array, grasping a single tube with one's fingers is difficult. Additionally, the racks of tubes are often heated or chilled increasing the difficulty of single tube selection.

These and other circumstances make an ergonomic hand-held tube picker a useful tool in the modern laboratory environment.

SUMMARY OF THE INVENTION

The hand-held test tube picker of this invention preferably comprises a test tube pick system with an ergonomic hand-held pick unit and an electronic intelligence component to assist the user in accurately selecting, transporting and placing individual test tubes in a typical tube array.

The hand-held pick unit has an elongated hand-grip portion, a control portion and an extended picker portion. The hand-grip portion is suitable for housing a power supply and actuator mechanisms. The control portion includes the triggering electronics and in the preferred embodiments, the instructional features, including an electronic display and processing means to instruct and direct the user.

In the simplest system, the hand-held pick unit has a cable and is connected to a computer as a peripheral in the form of a character display device.

In this system, the computer provides power for the picker mechanism and includes an application program with a database for tube identification and location, and the protocol for re-arrangement. Here, the hand-held pick unit is a dumb terminal having a display that alerts the user to what tube must be located and picked up, and where it is to be placed.

With minor modification, this system can be wireless by inclusion of a power pack and a simple wireless data system, such as an infrared light or radio frequency signal receiver. A small dedicated processor, if not a part of the display, translates the wireless signal and renders or activates the appropriate alphanumeric characters in the display. Typically, each tray and rack are identified and the location in a 96 tube rack can be identified by A-H row letter and 1-12 column number. The preferred hand-held pick unit also includes one or more control switches including a trigger switch to capture and release a selected tube and scroll switches to scroll up or down work lists for identified tubes and locations.

As inexpensive processors improve, and as test tube storage systems become even more sophisticated, the hand-held pick unit can incorporate additional on-board features. For example, barcoded trays, racks and even individual tubes are an advanced state-of-the-art practice. Incorporating barcode scanners and image readers in the hand-held test tube picker is advantageous. Additionally, with the miniaturization of r.f. I.D. tags, the hand-held unit becomes a convenient platform for activating the tag and tracking to the location of a desired tube for selection and removal.

These and other features are described in greater detail in the "Detailed Description of the Preferred Embodiment."

DETAILED DESCRIPTION OF THE PREFERRED EMBODIMENTS

Figure 1:
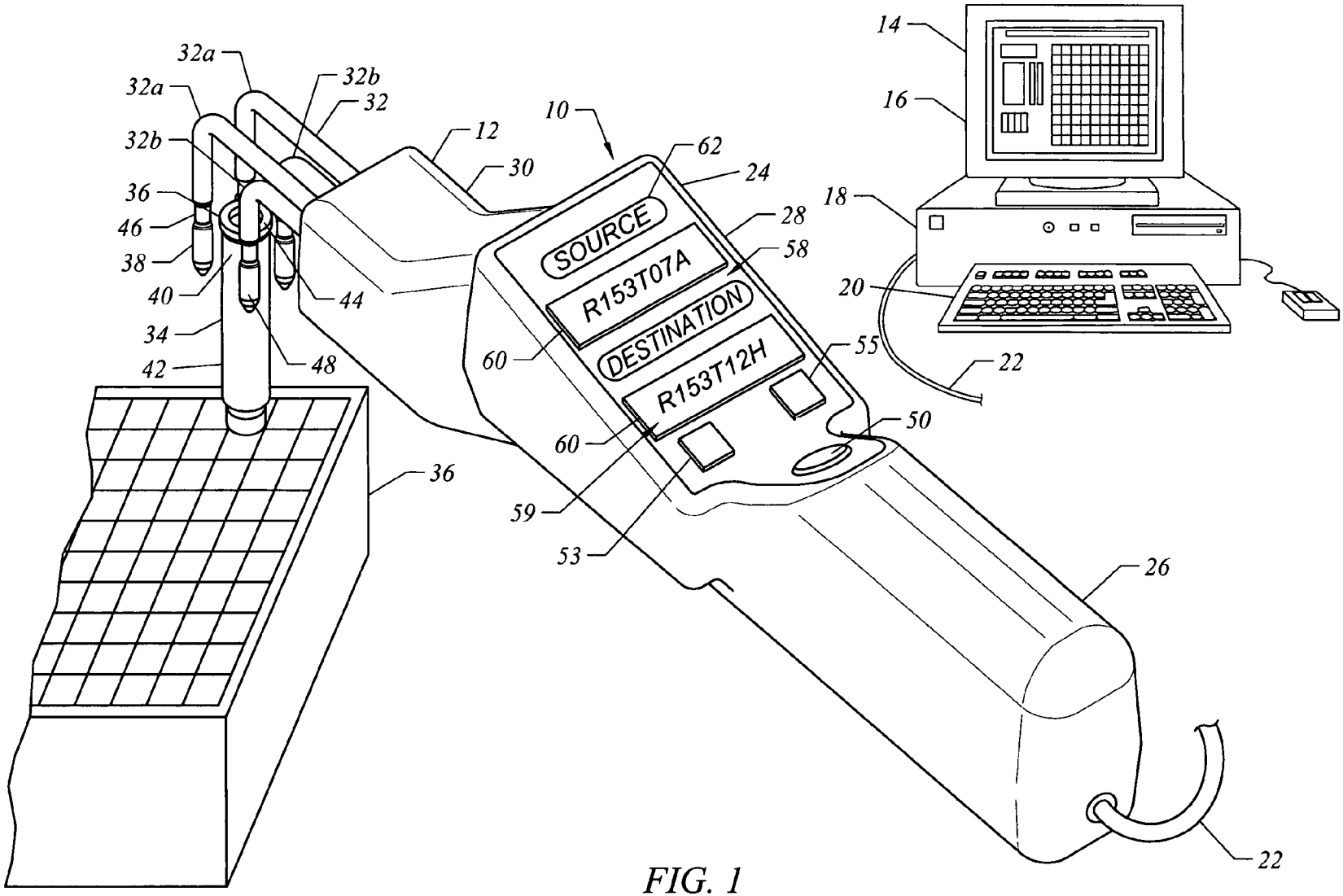
FIG. 1 is a perspective view of the hand-held pick unit in a test tube pick system.

Referring to FIG. 1, one preferred test tube pick system 10 is shown with a perspective illustration of the ergonomic hand-held pick unit 12 in combination with a computer 14. The computer 14 is in the form of an ordinary personal computer with a monitor 16, a processing unit 18 and a keyboard 20, and is connected to the hand-held pick unit 12 by a cable 22. As previously mentioned, the cable 22 can be eliminated when the hand-held unit and computer include a wireless communication system, such as infrared or radio frequency signal processing systems common with many computers for communication with peripheral input devices including a mouse or controller, or with local area networks.

The hand-held pick unit 12 has a housing 24 with a hand-grip portion 26, a control portion 28, and an extended pick portion 30 with projecting pick fingers 32. Because of the orthogonal arrangement of test tubes 34 (one shown in FIG. 1) in a rack 36 (a portion of which is shown in FIG. 1 in phantom), four fingers 32 are optimal.

The fingers 32 in the form of slender rods are bent to provide clear visibility of the top 36 of the tube 34 when the parallel end prongs 38 are positioned around the upper portion 40 of the tube casing 42. The tube 34 may be provided with a stopper or cap 44 that may have a diameter slightly larger than the upper portion 40 of the tube casing 42. The bent end prongs 38 are spaced apart and have a constricted portion 46 to accommodate the cap 44 if of greater diameter than the casing 42. The prong ends 46 may be covered by a nipple 48 to protect the casing which is usually fabricated from a plastic material.

Figure 2:
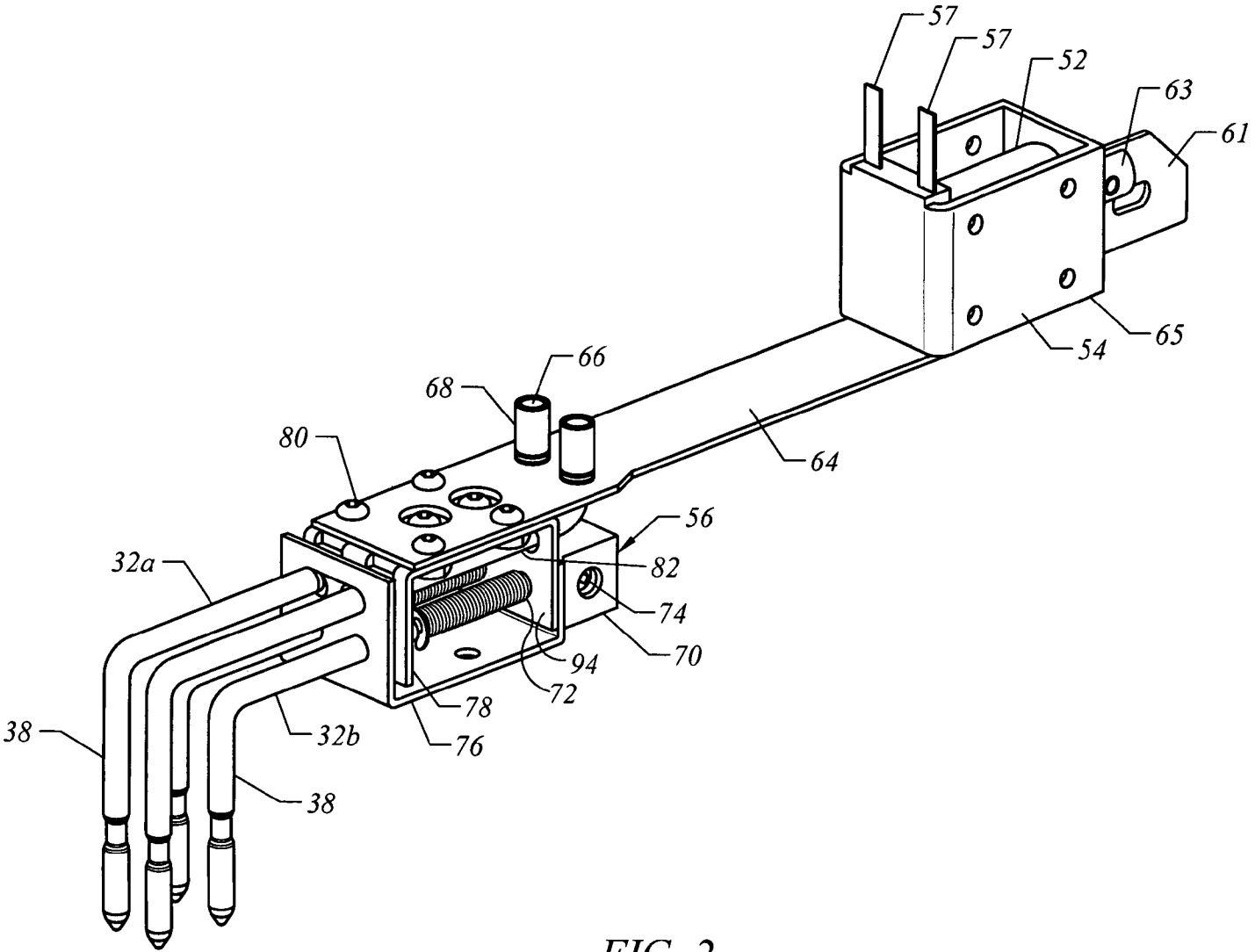
FIG. 2 is a perspective view of the actuator mechanism contained within the housing of the hand-held pick unit of FIG. 1.

The control portion 28 of the housing 24, at the minimal, has a trigger button 50 that actuates the opening and closing of the gripping prongs 38. It is to be understood that the trigger button 50 is a switch and could be replaced by a manual or electronic trigger on the underside of the control portion 28 of the housing 24. The preferred trigger button 50 is an electronic switch that actuates the solenoid 52 of an actuator mechanism 54 as shown in FIG. 2. Although different actuation protocols can be effective, it is preferred that the prongs 38 are in the normally closed or gripping position. When the trigger button 50 is pressed and the solenoid actuated, the outer fingers 32*a* displace and spread to accommodate the tube casing 42 and cap 44 as shown in slightly exaggerated form in FIG. 1. When the button 50 is released, a spring return mechanism 56 shifts the gripping prongs 38 to a closer gripping position. In this manner, a gripped test tube 34 will not be inadvertently dropped by a power failure or thumb displacement in reverse procedure with the gripping position activated by pressing the trigger button 50.

In a preferred embodiment, the control portion 28 of the housing 24 has a display 58 in the form of two separate inexpensive LCD screens 60. The inexpensive LCD screens 60 can be replaced with alphanumeric character generators, plasma screens, or a single screen of desired type.

The separate screens 60 permit the use of simple labels 62 to identify the information in a particular screen, such as the "SOURCE" and "DESTINATION" labels 62 in the FIG. 1 embodiment. The screens 60 generate alphanumeric characters 59 according to a work log produced by the computer application program. As an example, "R153TO7A" and "R153T12H" indicate tube in row A, column 07, is to be selected from rack 153 and placed in the same rack at location row H, column 12. Other identification and location tags can be used and the procedure varied, for example, by including a step to check a barcode on the tube bottom with a barcode reader (not shown).

Additionally, the control portion 28 of the housing 24 includes a pair of button switches 53 and 55. The button switches 53 and 55 are programmed to control the scrolling of the work log, with button switch 53 moving the log list forward and button switch 55 moving the log list backward. Other controls may be added for particular applications as needed.

The hand-grip portion is configured for convenient and ergonomic gripping by a user's hand and forms a cavity for a portion of the actuator mechanism in one embodiment or for a power pack in another wireless embodiment.

Figure 4:
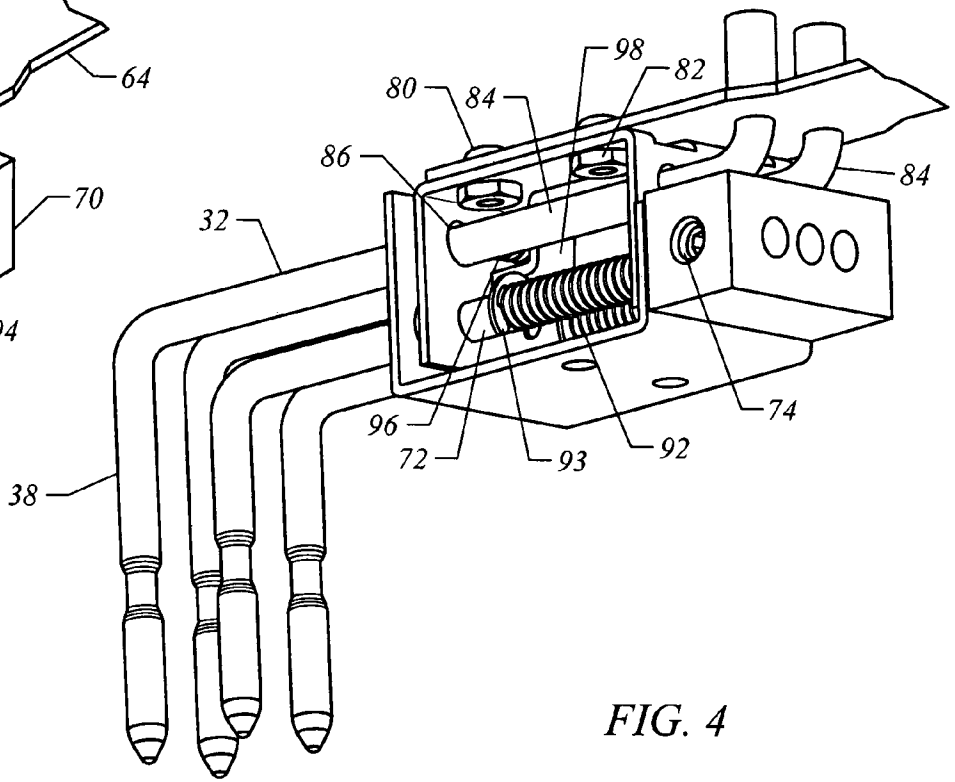
FIG. 4 is a second perspective view of an enlarged portion of the actuator mechanism of FIG. 2.
Figure 3:
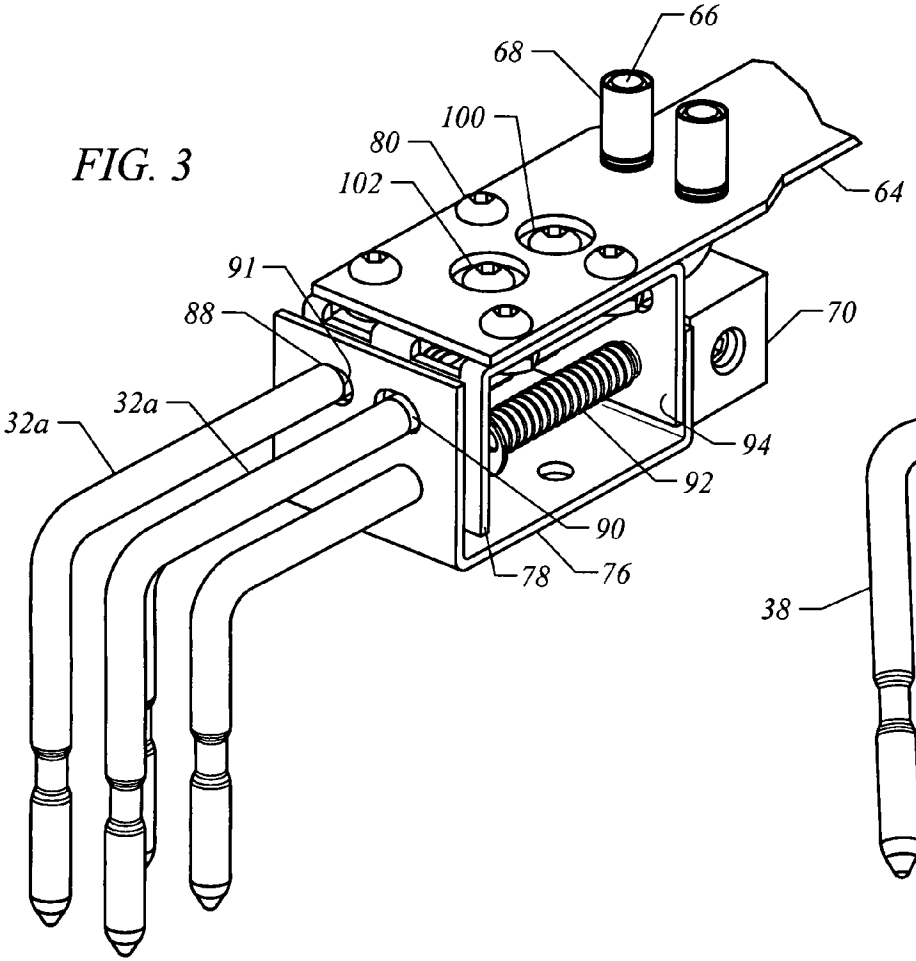
FIG. 3 is a first perspective view of an enlarged portion of the actuator mechanism of FIG. 2.

Referring to FIGS. 2-4, the actuator mechanism 54 includes the solenoid 52 that is electrically connected to the trigger button 50 by terminals 57. The actuated core rod 63 is connected to bent tab 61 at the end of an extension plate 64 that runs under the solenoid casing 65 and is in turn connected to the upwardly bent ends 66 of the displaceable fingers 32*a* capped with sleeve nuts 68. The extension plate 64 and fingers 32*a* engage the spring return mechanism 56 which anchors the fixed fingers 32*b*. The extension plate 64 enables the solenoid 52 to be physically displaced from the spring return mechanism 56 for balance of the hand-held unit 12.

Notably, where the hand-held unit 12 is wireless and the cavity in the hand-grip portion is utilized for a battery pack, the solenoid 52 can be relocated adjacent to the spring return mechanism 56, while retaining the balance of the overall unit.

The spring return mechanism 56 includes an anchor block 70 for the ends 72 of the stationary fingers 32*b* which are positioned and fixed to the anchor block 70 by set screws 74. The anchor block 70 is fixed to an outer U-shaped bracket 76 through which the stationary fingers 32*b* project. The outer U-shaped bracket 76 is secured to the housing 24 and traps an inverted inner U-shaped bracket 78 that is fastened to the extension plate 64 by four machine screws 80 with nuts 82. The outside span of the inner U-shaped bracket 78 is incrementally smaller than the inside span of the outer U-shaped bracket 76. This allows a limited displacement of the inner U-shaped bracket 78, and hence the displaceable fingers 32*a* relative to the outer U-shaped bracket 76. The degree of displacement depends on the size of tube being grasped by the fingers and the desired diagonal travel of the fingers.

As shown in FIGS. 3 and 4, the displaceable fingers 32*a* are anchored at their upwardly bent ends 66 and have end portions 84 passing through oval guide holes 86 and 88 in both the inner and outer U-shaped brackets 78 and 76, respectively. The oval guide holes 88 in the outer U-shaped bracket 76 are sized to co-act with constricted segments 90 in the end portions 84 of the displaceable fingers 32*a* as a cam action guide 91 when the solenoid 52 is deactivated and the displaceable fingers 32*a* are displaced. In the deactivated state, the displaceable fingers 32*a* are displaced closer together and as a pair, are displaced closer to the fixed fingers 32*b* in a gripping position. This position is induced and maintained by a pair of compression springs 92 seated on C-clips 93 fixed in notches (not shown) on the ends 72 of the stationary fingers and in biased contact with an arm 94 of the inner U-shaped bracket 78.

With the casing 65 of the solenoid 52 mounted to the housing 24 of hand-held unit 12, activation of the solenoid 52 retracts the core rod 63 displacing the extension plate 64 and hence the connected inner U-shaped bracket 78 against the compression springs 92 to displace and spread the displaceable fingers 32*a* relative to the fixed fingers 32*b*.

In this position, the end prongs 38 are in their relative open position to encompass the upper portion of a tube casing 42 preparatory to gripping the tube, or in the alternative, to release a tube held by the hand-held unit 12. To maintain the spread of the displaced prongs, a small spreader spring 96 is shown in part in FIG. 4, is compressed and positioned between the end portions 84 of the displaceable fingers 32*a*. The location of the spreader spring 96 is maintained by a small S or Z-shaped locator bracket 98 fixed to the underside of the inner U-shaped bracket 78 by a screw and nut assembly 100. The screw and nut assembly 100 is accessible through holes 102 in the end of the extension plate 64.

Figure 5:
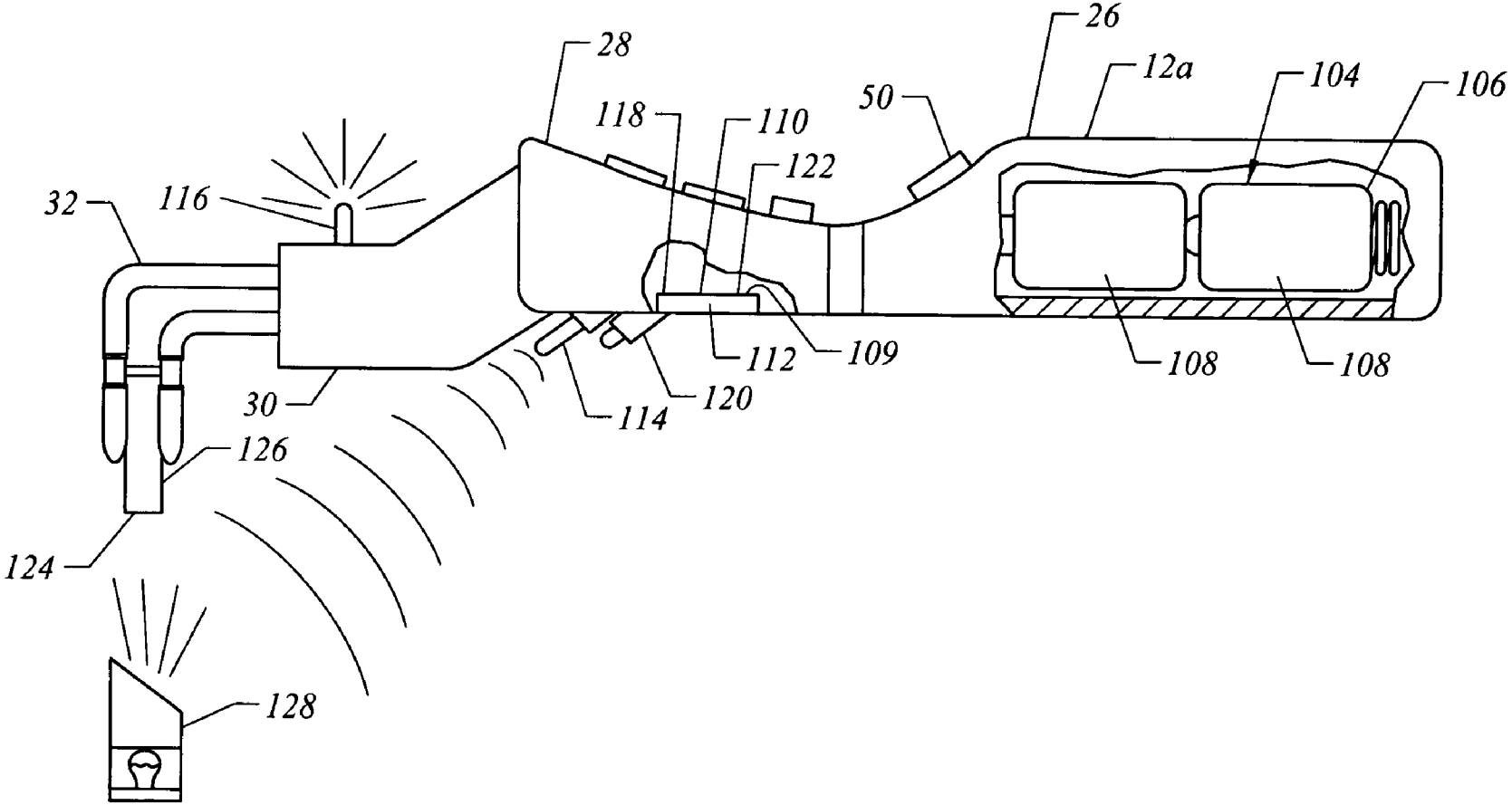
FIG. 5 is a side view partially broken away of an alternate embodiment of the hand-held pick unit of FIG. 1.

As noted, the hand-held pick unit 12 may alternately comprise a wireless hand-held pick unit 12*a*, as shown in the side view in FIG. 5. The alternate hand-held pick unit 12*a*, as previously noted, has a power pack 104 in a cavity 106 in the hand grip portion 26. The power pack 104 comprises a pair of batteries 108 as shown in the broken away portion of the housing 24. As noted, the solenoid (not shown) can be moved to the control portion 28 of the housing 24. In the control portion 28, there is included a microprocessor 109 that controls the operation of the hand-held pick unit 12*a* and the r.f. circuitry 110 which may reside on a common board 112. The r.f. circuitry 110 operates a transceiver probe 114 on the underside of the unit 12*a* for activating and reading any RFID (radio frequency identification) tags on individual racks or tubes. The r.f. circuitry 110 also operates a transceiver antenna 116 for wirelessly communicating with an associated computer or other communication linking device. It is to be understood that the capabilities of the pick units 12 and 12*a* can be varied according to the power of the on-board processor and the degree of delegation of functions to the wired and wireless units for detecting, processing and communicating.

It is to be understood that the extension plate 64 is effectively the actuator arm for the actuator mechanism and the solenoid drive device could be replaced with a manual thumb slide or pneumatic piston mechanism. However, as a preferred electronic unit, an electronic drive device such as the solenoid, is considered optimum.

Similarly, in an electronic unit, the r.f. circuitry 110 can be replaced with or include an i.r. component 118 for wireless communication with a remote device, such as a host computer of the type schematically illustrated in FIG. 1. Also, other detecting components, such as a camera probe 120, can be included with the circuitry of a charge-couple device (CCD) 122 on the common board 112. The CCD 122 views the reflected barcode marker 124 on the bottom of a barcode marked tube 126 with the aid of a light prism 128 as an auxiliary countertop or rack associated component. These and other features can be added to a basic picker unit.

While, in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

The invention claimed is:

1. A hand-held pick unit for selecting, transporting and placing test tubes, the pick unit comprising:

a housing having a hand-grip portion, a control portion and a pick portion, wherein:

the hand-grip portion is ergonomically configured for convenient gripping, the control portion has at least an actuator control operable by a user, and the pick portion has four extending finger members having bent ends, wherein the bent ends form four parallel spaced end prongs; and, an actuator mechanism contained in the housing and having an actuator member connected to two of the extending finger members and actuated by the actuator control, wherein on user operation of the actuator control, the actuator mechanism displaces the actuator member and the two extending finger members connected to the actuator member and displaces the end prongs of the displaced finger members relative to the other two end prongs, wherein the actuator mechanism includes a cam action guide that co-acts with the two displaceable finger members to spread the displaceable finger members when the displaceable finger members are displaced, and wherein the cam action guide comprises a bracket having oval holes and two displaceable finger members are slender rods arranged through the holes in contact with the bracket with constricted portions of the rods proximate the oval holes, wherein the constricted portions allow the finger members to spread when the finger members are displaced and the constricted portions locate in the oval holes in contact with the bracket.

2. The hand-held pick unit of claim 1, wherein the actuator mechanism is electronically controlled, the pick unit having a power source and the actuator mechanism having a solenoid with a displaceable core rod connected to the actuator member and to the two displaceable finger members, wherein the power source is connected to the actuator control and to the solenoid wherein user operation of the actuator control activates the solenoid, displaces the two extending finger members connected to the actuator member of the actuator mechanism and further spaces the end prongs on the two displaced finger members from the other two end prongs.

3. The hand-held pick unit of claim 1, wherein the actuator mechanism includes a spring mechanism that returns the prongs to a gripping position when the actuator mechanism is de-activated by the user.

4. The hand-held pick unit of claim 3, wherein the cam action guide includes a retainer bracket and a compression spring, wherein the compression spring is located between the displaceable finger members in contact with the displaceable finger members and is retained in position by the retainer bracket.

5. A hand-held pick unit for selecting, transporting and placing test tubes, the pick unit comprising:

a housing having a hand-grip portion, a control portion and a pick portion, wherein:

the hand-grip portion is ergonomically configured for convenient gripping, the control portion has at least an actuator control operable by a user, and the pick portion has four extending finger members having bent ends, wherein the bent ends form four parallel spaced end prongs; and, an actuator mechanism contained in the housing and having an actuator member connected to two of the extending finger members and actuated by the actuator control, wherein on user operation of the actuator control, the actuator mechanism displaces the actuator member and the two extending finger members connected to the actuator member and displaces the end prongs of the displaced finger members relative to the other two end prongs wherein the actuator mechanism is electronically controlled, the pick unit having a power source and the actuator mechanism having the actuator member electronically displaceable, wherein the power source is connected to the actuator control and to the actuator mechanism, wherein user operation of the actuator control activates the actuator mechanism and displaces the actuator member and connected finger members wherein the control portion of the housing has at least one display adapted to display alphanumeric characters.

6. The hand-held pick unit of claim 5, wherein the power source is remote from the pick unit and connected to the pick unit by a cable.

7. The hand-held pick unit of claim 5, wherein the power source comprises a power pack in the housing of the hand-held pick unit.

8. The hand-held pick unit of claim 5, wherein the alphanumeric characters represent one of the test tube locations where a tube is to be selected and where a tube is to be placed.

9. The hand-held pick unit of claim 5, wherein the control portion of the housing has a pair of displays adapted to display alphanumeric characters, wherein one display displays alphanumeric characters representing the source of a test tube to be picked and the other display displays alphanumeric characters representing the destination of a test tube to be placed.

10. The hand-held pick unit of claim 9, wherein the control portion of the housing includes control switches that change the alphanumeric characters in the displays.

11. The hand-held pick unit of claim 10, wherein the pick unit is part of a test tube pick system that includes a computer that communicates with the hand-held pick unit and coordinates the routine for picking and placing test tubes.

12. The hand-held pick unit of claim 5, wherein the power source comprises a power pack in the housing and the hand-held pick unit has wireless communication means for communicating with a remote device.

13. The hand-held pick unit of claim 5, further comprising electronic detecting circuitry that activates and detects radio frequency identification tags.

14. The hand-held pick unit of claim 5, further comprising electronic detecting circuitry that detects bar code markings.

15. The hand-held pick unit of claim 5, including a processor and means for detecting information related to at least one of a test tube identification and a test tube storage location.

* * * * *